United States Patent [19]

Herrmann, Jr.

[11] 4,166,664

[45] Sep. 4, 1979

[54] HIGH VOLTAGE QUICK DISCONNECT ELECTRICAL CONNECTOR ASSEMBLY

[75] Inventor: Henry O. Herrmann, Jr., Mt. Joy, Pa.

[73] Assignee: AMP Incorporated, Harrisburg, Pa.

[21] Appl. No.: 876,582

[22] Filed: Feb. 9, 1978

Related U.S. Application Data

[63] Continuation of Ser. No. 544,032, Jan. 24, 1975, abandoned.

[51] Int. Cl.[2] ..... H01R 13/54

[52] U.S. Cl. ..... 339/91 R; 339/60 M; 339/111

[58] Field of Search ..... 339/75 R, 17, 91 R, 339/91 B, 111, 116 C, 94 M, 60 M, 45 M, 46

[56] References Cited

U.S. PATENT DOCUMENTS

| | | | |
|---|---|---|---|
| 2,411,861 | 12/1946 | Antony et al. | 339/60 M X |
| 2,860,316 | 11/1958 | Watters et al. | 339/89 R |
| 2,892,991 | 6/1959 | Beebee et al. | 339/91 B |
| 3,156,513 | 11/1964 | Peterson et al. | 339/91 R X |
| 3,176,259 | 3/1965 | MacNamara | 339/91 R |
| 3,336,562 | 8/1967 | McCormick et al. | 339/45 M |
| 3,430,184 | 2/1969 | Acord | 339/45 M |
| 3,452,316 | 6/1969 | Panek et al. | 339/45 M |
| 3,522,575 | 8/1970 | Watson et al. | 339/89 M |
| 3,697,928 | 10/1972 | Hammell | 339/91 R X |
| 3,888,559 | 6/1975 | Geib | 339/46 |

FOREIGN PATENT DOCUMENTS

| | | | |
|---|---|---|---|
| 2063258 | 7/1971 | Fed. Rep. of Germany | 339/91 R |

*Primary Examiner*—E. F. Desmond
*Attorney, Agent, or Firm*—Russell J. Egan

[57] ABSTRACT

A high voltage, quick disconnect electrical connector assembly is disclosed formed from entirely dielectric members which assure rapid disconnection of the assembly even in the unlikely event of jamming of the normal disconnect mechanism. The connector assembly includes a pair of mating housing members with latching inserts fixed in a receptacle member and engaging in a plug member of the assembly. The quick disconnect feature is provided by an annular shroud member which slides axially on the receptacle member between a first position in which the latching inserts are in a normally outward position allowing free insertion of the plug into the receptacle and a second position in which the shroud biases the latching inserts so that lobes on the free ends thereof project into respective detents in the plug portion to lock the connector members together. The latching inserts each are provided with a narrow cross-sectioned neck portion which will break upon application of a predetermined force, in the event of jamming of the regular disconnect mechanism. A wiping seal is provided adjacent the free end of the shroud to perform a sealing function between connector members during disconnection to prevent arcs generated during disconnection from coming in contact with the external and possibly explosive environment. Thus the assembly is substantially explosion proof, even in an explosive environment, and fail safe in disconnection.

6 Claims, 5 Drawing Figures

HIGH VOLTAGE QUICK DISCONNECT ELECTRICAL CONNECTOR ASSEMBLY

CROSS REFERENCE TO RELATED APPLICATION

The present application is a continuation of my application Ser. No. 544,032 filed Jan. 24, 1975, and now abandoned.

BACKGROUND OF THE INVENTION

1. The Field of the Invention

The present invention relates to high voltage connectors and, in particular, to such electrical connectors which are of the quick disconnect type.

2. The Prior Art

High voltage electrical connections are heretofore constructed have been generally unsatisfactory for high altitude aircraft uses for several reasons. As the elevation becomes greater at which the high voltage electrical equipment is used, the atmosphere pressure and hence the insulating qualities of the atmosphere against arcing decrease so that at higher elevations, such as obtained in the use of modern aircraft, the insulation qualities of the atmosphere may drop to a small fraction of what they are near the surface of the earth. Thus, ordinary electrical connectors will arc over at these high altitudes and become useless. Furthermore, ordinary connectors generally have exposed leads which are a source of leakage and arcing and also constitute a serious menace to those handling the apparatus.

Further, it is quite clear that when an electrical connector is used in an aircraft to connect electrically operated equipment to the flying suit of the aviator or otherwise to his person, it is essential that the connector be able to rapidly and positively disconnect in case of an emergency situation requiring the aviator to eject from the aircraft. While it is convenient to have such connectors with a quick disconnect function so that the pilot may enter and leave the aircraft in an essentially unheeded manner, it is absolutely essential that the connector disconnect in a fail proof fashion under emergency conditions.

From the foregoing, it is quite apparent that the previously known quick disconnect type structures, such as those described in U.S. Pat. Nos. 2,892,991; 3,156,513; 3,336,562; 3,430,184; 3,452,316 and 3,888,559, will not all fulfill the above stated needs. Further, high voltage connectors, such as those described in U.S. Pat. Nos. 2,411,861; 2,860,316; 3,522,575 and 3,697,928 will not provide the necessary high voltage and quick disconnect functions. The present invention in particular constitutes an improvement over the connector of U.S. Pat. No. 3,888,559 in providing positive operation together with manufacturing economies.

It is highly desirable to have such an electrical connector designed so that not only can it be rapidly and effectively disconnected, but that it also have a positive locking indication showing it is completely assembled and have a fail safe system which will insure its rapid disconnection at all times.

SUMMARY OF THE INVENTION

The present high voltage, rapid disconnect electrical connector assembly includes a pair of mating plug and receptacle members. The receptacle member has a plurality of latching members secured to a receptacle housing extending about a mating face in cantilever fashion.

An annular shroud member is slidably mounted on the receptacle housing and in a first position allows the latching members to lie in their normal position clearing the mating face for engagement by the plug. When shroud is in a second position, the latching members are biased into appropriate recesses in the plug member to latchingly secure the members together. The latch members have a narrow neck portion which will break upon the application of a force exceeding a predetermined force thus obviating any jamming of the connector which could prevent disconnect. The receptacle member is also provided with an annular wiping seal which provides a continuous seal between the plug and receptacle members during the disconnection operation thereby preventing arcs generated during disconnection from coming in contact with an external and possibly explosive atmosphere.

It is accordingly an object of the present invention to produce a high voltage electrical connector having a quick disconnect feature.

It is another object of the present invention to produce a high voltage quick disconnect connector which will prevent arcing from the connector encountering the environment during a disconnecting operation.

It is yet another object of the present invention to produce a high voltage quick disconnect electrical connector which will disconnect in a fail safe manner under all conditions.

It is a further object of the present invention to produce a high voltage quick disconnector which will give an audible and tactile indication of mating.

It is a still further object of the present invention to produce an high voltage quick disconnect electrical connector which can be readily and economically manufactured.

The means for accomplishing the foregoing objects and other advantages of the present invention will become apparent to those skilled in the art from the following detailed description taken with reference to the accompanying drawings.

DETAILED DESCRIPTION OF THE PREFERRED EMBODIMENT

Figure 1:
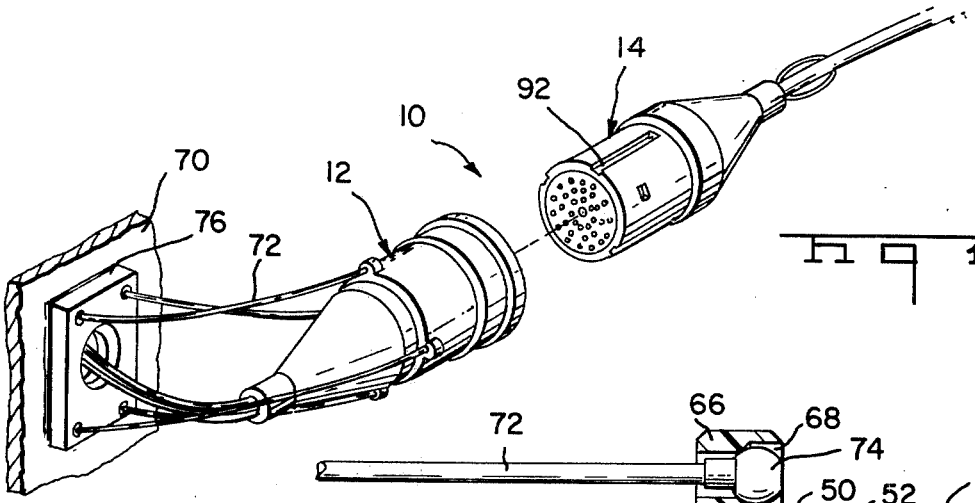
FIG. 1 is a perspective view of a high voltage, quick disconnect electrical connector in accordance with the present invention.

The high voltage quick disconnect electrical connector 10 in accordance with the present invention includes a receptacle member 12 and a mating plug member 14. Both members are made entirely of dielectric materials.

The receptacle 12 includes a contact housing 16 having a plurality of contact passages 18 therein opening onto a mating face 20. The housing 16 is shown with an insulating insert 22 so that the assembly will accommodate both high voltage contacts 24 and low voltage contacts 26, each of the contacts being terminated on a respective conductor 28, 30. The housing 16 is provided with external threads 32 on a rear portion thereof. A boot 34 is provided with an outwardly directed forward lip 36 and internal threads which engage threads 32. The boot serves as a flexure guard for the conductors and can also provide a sealing function. The housing 16 also has a plurality of latch receiving recesses 38 spaced about the mating face 20. Each recess 38 includes an outwardly directed projection 40. A like plurality of latch members 42 are received in the respective recesses 38 with each latch having an inwardly directed recess 44 which engages the projection 40 holding the latching member on the housing 16 in cantilever fashion. The free end of the latch has an enlarged ball 46 with a narrow neck 48 adjacent the ball. The latching members have an outwardly directed recess 50 and shoulder 52. An annular shroud 54 is mounted on the housing 16 for axial sliding movement. The shroud 54 includes an inwardly directed annular flange 56 near its rear end which slides in recess 50, the sliding movement being limited by lip 36 and shoulders 52. The shroud 54 also has a like plurality of passages 58 which receive the latching members 42 therein to key the shroud to the housing 16. Each passage 58 also includes a cam surface 60 which bears against the ball 46 of the latch members 42. An inwardly directed, annular wiping seal 62 is secured at the forward end of shroud 54 and at least one keying projection 64 extends longitudinally along the inner surface of the shroud. The shroud 54 is completed by outwardly directed integral projections 66 each of which has a profiled passage 68 therein.

The receptacle member 12 is normally flexibly attached to a bulkhead 70 by a plurality of lanyards 72. The lanyards 72 have balls 74 fixed to one end and received in passages 68 and their other ends secured to ring 76 fixed to the bulkhead 70.

The plug member 14 includes a contact housing 78 having a plurality of contact bores 80 therein opening onto mating face 82. The plug can also include an insert 84 for high voltage contacts 86 while low voltage contacts 88 are mounted in the respective remaining bores. The housing 78 has a plurality of outwardly directed recesses 90 positioned to receive the balls 46 of the respective latching members and elongated recesses 92 to receive the respective keys 64. A boot 94 completes the plug by being threadedly received on the rear threaded portion 96 of the plug housing 78.

There are preferably four latching members spaced 90° apart about the periphery of the receptacle member and they are preferably formed of an electrically non-conductive plastic material. They have a certain amount of resilience which allows them to go from the normally open position shown in FIGS. 2 and 3 to a biased closed position shown in FIG. 4. The inserts 22 and 84 are preferably formed of a silicone rubber and will receive high voltage conductors therein and provide a suitable seal for the conductors.

The receptacle is assembled by first inserting the terminated contacts through the boot 34 and into their respective passages in housing 16. The shroud is slipped completely over the assembly adjacent the boot. The latching members 42 are inserted into their respective cavities with the projection 40 received in the recesses 44. The shroud 54 is moved forward to be positioned over the latching members to both hold them in place to be keyed to the housing. The sealing boot 34 is threaded on the rear of the housing to hold the shroud in place. The plug is assembled in similar fashion by feeding the terminated conductors through boot 94, inserting the terminals in their respective bores, and threading the boot onto housing 78.

Figure 2:
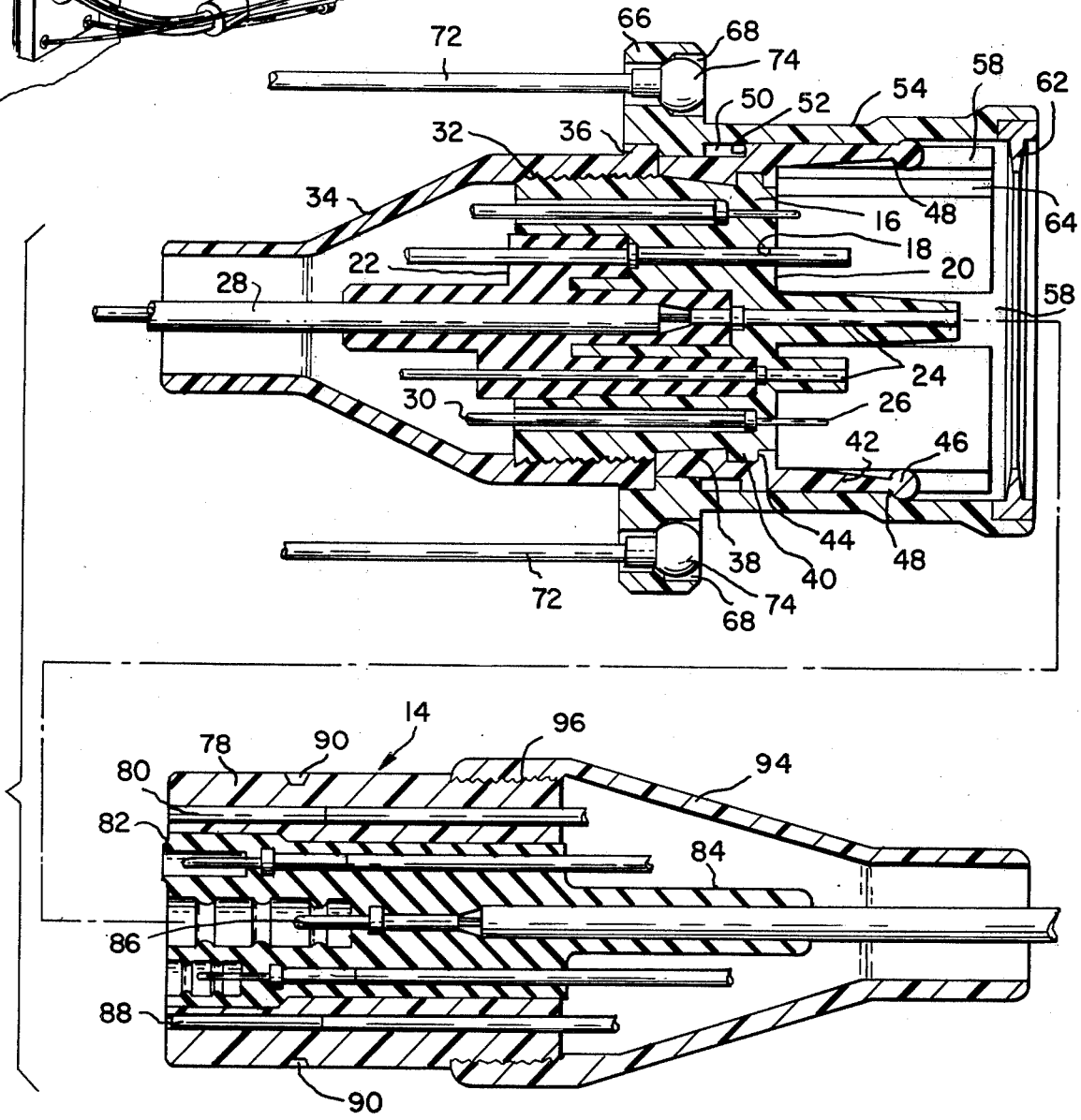
FIG. 2 is a longitudinal cross-section through the connector assembly of FIG. 1.
Figure 3:
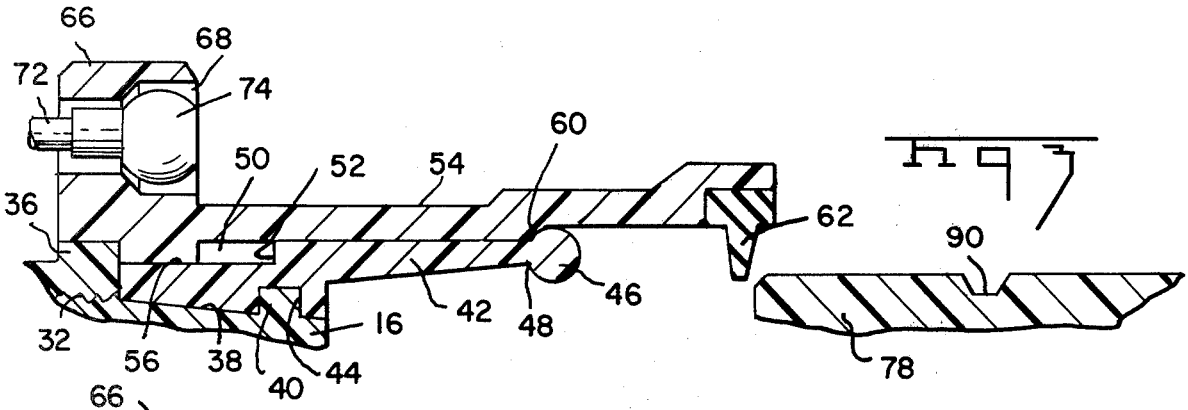
FIG. 3 is a fragmentary longitudinal cross-section showing a latch member and portions of the annular shroud and annular seal prior to mating of the connector members.
Figure 4:
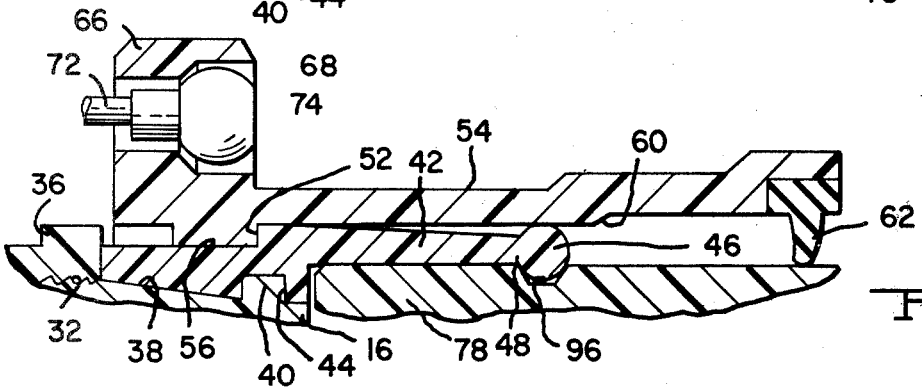
FIG. 4 is a fragmentary longitudinal cross-section similar to FIG. 3 showing a latch member and portions of the annular shroud, and annular seal in an engaged and locked condition of the connector members.
Figure 5:
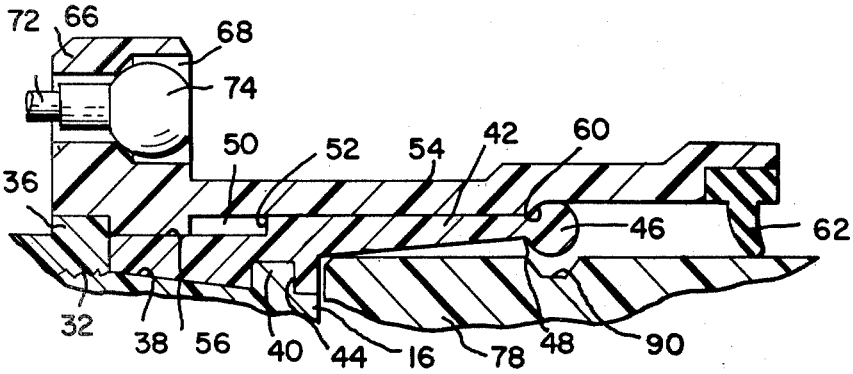
FIG. 5 is a fragmentary longitudinal cross-section similar to FIGS. 3 and 4 showing a latch member and portions of the annular shroud and annular seal shortly after commencement of disconnection of the connector members.

In operation of the connector assembly, the shroud is moved to the position shown in FIGS. 2 and 3 so that the latching members are in their normal outermost position freeing the aperture for receiving the plug member therein. As the plug is fully mated into the receptacle, the shroud moves relative to the housing to bias the latching members into locking engagement with the plug member. To disconnect a connector assembly, a force is applied to the plug which will move the whole assembly until stopped by the lanyards. The lanyards will pull on the shroud causing relative movement between it and the receptacle housing until the latching members are able to move past the cam surface and release the plug from the receptacle. In the unlikely event that something prevents the shroud from obtaining this relative movement, the frangible necks of the latching members will give way and allow the plug to disconnect from the receptacle. However, the connector is substantially failproof because there are no exposed shoulders or parts which can lock to interfere with the disconnect movement.

During the disconnect movement the seal is in constant wiping engagement with the outer surface of the plug. Thus the chamber formed between the plug, receptacle housing and shroud is shielded from the environment during disengagement so that any arcing that may occur is contained in the connector assembly itself thereby avoiding arcing into a possibly explosive atmosphere during unmating.

All of the materials of the plug and receptacle are preferably electrically non-conductive material, with exception of the lanyards and the crimp-on balls. Obviously all wires, terminals, and conductors are electrically conductive. The preferred embodiment includes crimp-on type, snap-in pins and terminals which are put in the respective housings and the high voltage leads are preferably held in the housing cavities formed in a silicone rubber which does not require potting.

The present invention may be subject to many modifications and changes without departing from the spirit or essential characteristics thereof. The present embodiment should therefore be considered in all respects as illustrative and not restrictive of the scope of the invention.

What is claimed is:

1. A high voltage, quick disconnect electrical connector assembly, comprising:

a plug member having a housing with a plurality of low voltage electrical terminals mounted therein in a patterned array, a high voltage insert containing high voltage terminals and mounted in said housing amid said array, and at least one detent on the outer surface of said plug member;

a receptacle member having a housing with a plurality of low voltage terminals mounted therein in a like patterned array, a high voltage insert containing high voltage terminals and mounted in said receptacle housing amid said array aligned for mating with said high voltage insert of said plug member and at least one recess on an outer surface of said receptacle member;

at least one latching member each having a first end fixedly secured in a respective recess of said receptacle housing and a second end engageable in a respective detent in said plug housing, said latching members having a neck portion adapted to give way upon application of a force exceeding a predetermined amount; and an annular shroud member axially slidable along said receptacle housing, said annular shroud in a first position allowing said latching members to lie in a normal position opening said receptacle for reception of said plug and in a second position biasing said latching members to a condition in which they engage in said detents, and an annular seal on a free end of said shroud forming a wiping sealing engagement with said plug during mating and unmating of said assembly whereby any arcing is contained within the assembly and a long arc path is defined by said high voltage inserts together and said array of low voltage terminals so that said assembly can be used in an explosive environment in safety.

2. A high voltage, quick disconnect electrical connector assembly according to claim 1 further comprising:

lanyard means securing said annular shroud member to a fixed member whereby a pulling force applied to said assembly causes said shroud to move from the second to the first position.

3. A high voltage, quick disconnect electrical connector assembly according to claim 1 further comprising:

first keying means polarizing mating of said plug and receptacle members.

4. A high voltage, quick disconnect electrical connector assembly according to claim 1 further comprising:

second keying means stabilizing said shroud on said receptacle housing so as to prevent relative rotational movement.

5. A high voltage, quick disconnect electrical connector assembly according to claim 1 further comprising:

a sealing boot secured to a rear portion of each said plug and said receptacle members.

6. A quick disconnect, high voltage electrical connector assembly comprising:

a plug member having no moving parts and including a housing formed of rigid dielectric material, a plurality of contact passages in said housing opening onto a mating face in a patterned array, a like plurality of low voltage electrical contacts each positioned in a respective passage, a high voltage insert positioned within said housing amid said array, at least one high voltage terminal mounted in said insert, and at least one detent on an outer surface of said housing, a receptacle member having a housing formed of rigid dielectric material and profiled to mate with said plug member, said housing having a like plurality of contact passages opening onto a mating face in a like patterned array and aligned with said passages of said plug member and a low voltage electrical contact in each said cavity, a high voltage insert positioned within said housing amid said array with at least one high voltage terminal mounted in said insert each aligned with a respective high voltage terminal in said plug member, at least one latching member recess in an outer surface of said receptacle housing;

at least one elongated latch means each having one end fixed in a respective recess in said receptacle and extending therefrom in cantilever fashion normally allowing entry of said plug member into said receptacle member, said latch means having a lobe attached at end portion by a frangible neck;

an annular shroud member slidably mounted on said receptacle member for axial movement therealong between a first position forcing said latch means into said detents in said plug member for locking said members together and a second position in which said latch means freely assume their normal position;

lanyard means coupled between said shroud means and a fixed means allowing limited movement of said shroud means; and annular sealing means on said shroud sealing the space between said plug and receptacle from the external environment, said sealing means wiping against said plug during relative movement of said plug in said receptacle whereby any arcing occurring is contained within said assembly.

* * * * *